US012240727B2

(12) United States Patent
Takano

(10) Patent No.: US 12,240,727 B2
(45) Date of Patent: Mar. 4, 2025

(54) SHEET FOLDING DEVICE, SHEET POST-PROCESSING APPARATUS INCLUDING SHEET FOLDING DEVICE, AND IMAGE FORMING SYSTEM

(71) Applicant: KYOCERA Document Solutions Inc., Osaka (JP)

(72) Inventor: Yusuke Takano, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 151 days.

(21) Appl. No.: 18/336,620

(22) Filed: Jun. 16, 2023

(65) Prior Publication Data

US 2023/0416041 A1 Dec. 28, 2023

(30) Foreign Application Priority Data

Jun. 22, 2022 (JP) ..... 2022-100634

(51) Int. Cl.
*B65H 31/26* (2006.01)
*B65H 45/16* (2006.01)

(52) U.S. Cl.
CPC . *B65H 45/167* (2013.01); *B65H 2301/44318* (2013.01); *B65H 2801/27* (2013.01)

(58) Field of Classification Search
CPC ..... B65H 29/52; B65H 31/26; B65H 31/34; B65H 31/36; B65H 45/04; B65H 45/12; B65H 45/18; B65H 2301/4222; B65H 2301/4223; B65H 2405/324; B65H 2405/35; B65H 2405/354; B65H 2801/27
USPC ..... 270/32, 37, 58.12, 58.17
See application file for complete search history.

(56) References Cited

U.S. PATENT DOCUMENTS

| | | | | |
|---|---|---|---|---|
| 8,146,904 | B2 * | 4/2012 | Watanabe | B65H 45/18 270/32 |
| 8,191,885 | B2 * | 6/2012 | Hattori | B65H 31/3081 270/45 |
| 8,715,149 | B2 * | 5/2014 | Izumichi | B65H 45/142 493/442 |
| 8,960,660 | B2 * | 2/2015 | Furuhashi | B31F 1/0035 271/226 |
| 11,021,341 | B2 * | 6/2021 | Kishimoto | B65H 9/08 |
| 11,535,480 | B2 * | 12/2022 | Shimizu | B65H 45/18 |
| 2007/0120307 | A1 | 5/2007 | Izumichi et al. | 270/32 |

FOREIGN PATENT DOCUMENTS

JP 2007-145569 A 6/2007

* cited by examiner

*Primary Examiner* — Leslie A Nicholson, III
(74) *Attorney, Agent, or Firm* — Stein IP, LLC

(57) ABSTRACT

A sheet folding device includes a sheet loading unit, a folding processing unit, and an ejection roller. The folding processing unit includes a folding roller pair. A sheet alignment part and a sheet moving part are provided. A sheet loading tray includes an upstream-side loading part and a downstream-side loading part. The sheet alignment part includes an upstream-side alignment part and a downstream-side alignment part. The downstream-side alignment part includes a side plate, a fixed guide plate, and a movable guide plate supported on the side plate in such a manner as to be swingable between a retreat position and a regulation position.

7 Claims, 9 Drawing Sheets

SHEET FOLDING DEVICE, SHEET POST-PROCESSING APPARATUS INCLUDING SHEET FOLDING DEVICE, AND IMAGE FORMING SYSTEM

INCORPORATION BY REFERENCE

This application is based on and claims the benefit of priority from Japanese Patent Application No. 2022-100634 filed on Jun. 22, 2022, the contents of which are hereby incorporated by reference.

BACKGROUND

This disclosure relates to a sheet folding device, a sheet post-processing apparatus including the sheet folding device, and an image forming system.

A sheet post-processing apparatus conventionally used forms a bundle of a plurality of stacked sheets (printing sheets, envelops, OHPs, etc.) with images formed by an image forming apparatus (such as a copier or a printer), and performs a predetermined post-process on the bundle. The predetermined post-process includes a fastening process (a process of fastening a sheet bundle with a staple) and a folding process (a process of folding a sheet in two or three).

One of such sheet post-processing apparatuses includes a sheet folding device for performing the folding process. This sheet folding device includes a sheet loading unit, a sheet transport path, a folding processing unit, and a sheet alignment part.

The sheet loading unit is a unit on which a sheet is loaded. The sheet transport path is a path along which the sheet to be loaded on the sheet passes. The folding processing unit performs a predetermined folding process on the sheet loaded on the sheet loading unit.

The sheet alignment part abuts on the sheet loaded on the sheet loading unit to locate the sheet into position with respect to a sheet transport direction and a sheet width direction. The sheet alignment part includes a flat section (a fixed guide plate). The flat section is parallel to and faces a sheet loading surface (a surface on which a sheet is to be loaded) of the sheet loading unit. The sheet is loaded between the flat section and the sheet loading surface.

SUMMARY

A sheet folding device according to one aspect of this disclosure comprises a sheet loading unit, a folding processing unit, and an ejection roller. The sheet loading unit is a unit on which a sheet having passed through a sheet transport path is loaded. The folding processing unit includes a folding roller pair and performs a predetermined folding process on the sheet loaded on the sheet loading unit by nipping the sheet using the folding roller pair. The ejection roller is arranged downstream from the folding processing unit with respect to a sheet transport direction, and ejects the sheet having been subjected to the folding process downstream of the sheet transport direction. The sheet loading unit includes: a sheet loading tray on which the sheet is loaded; a sheet alignment part supported on the sheet loading tray in such a manner as to be movable back and forth with respect to a sheet width direction perpendicular to the sheet transport direction, the sheet alignment part abutting on the sheet loaded on the sheet loading unit to locate the sheet into position in the sheet width direction; and a sheet moving part supported on the sheet loading tray in such a manner as to be movable back and forth with respect to the sheet transport direction, the sheet moving part moving the sheet loaded on the sheet loading unit to a predetermined position in the sheet transport direction. The sheet loading tray includes: an upstream-side loading part arranged upstream of the sheet transport direction across a space formed at a position facing a nipping part at the folding roller pair, the upstream-side loading part including an upstream-side loading surface; and a downstream-side loading part arranged downstream of the sheet transport direction across the space, the downstream-side loading part including a downstream-side loading surface. The sheet alignment part includes: an upstream-side alignment part that abuts on a portion of the sheet loaded on the upstream-side loading part to locate the sheet into position in the sheet width direction; and a downstream-side alignment part that abuts on a portion of the sheet loaded on the downstream-side loading part to locate the sheet into position in the sheet width direction. The downstream-side alignment part includes: a side plate arranged upright to the downstream-side loading surface and abutting on a side surface of the sheet; a fixed guide plate provided upstream of the sheet transport direction from the side plate in such a manner as to face the downstream-side loading surface at a predetermined height from the downstream-side loading surface, the fixed guide plate regulating an upper surface of the sheet; and a movable guide plate provided downstream from the fixed guide plate with respect to the sheet transport direction, the movable guide plate being supported on the side plate in such a manner that a part upstream from a central part of the movable guide plate in the sheet transport direction is swingable between a retreat position and a regulation position about a fulcrum located above the fixed guide plate, the retreat position being a position where a downstream-side end portion of the movable guide plate in the sheet transport direction is located above the fixed guide plate, the regulation position being a position where the downstream-side end portion regulates an upper surface of the sheet at a position below the fixed guide plate.

DETAILED DESCRIPTION

Figure 1:
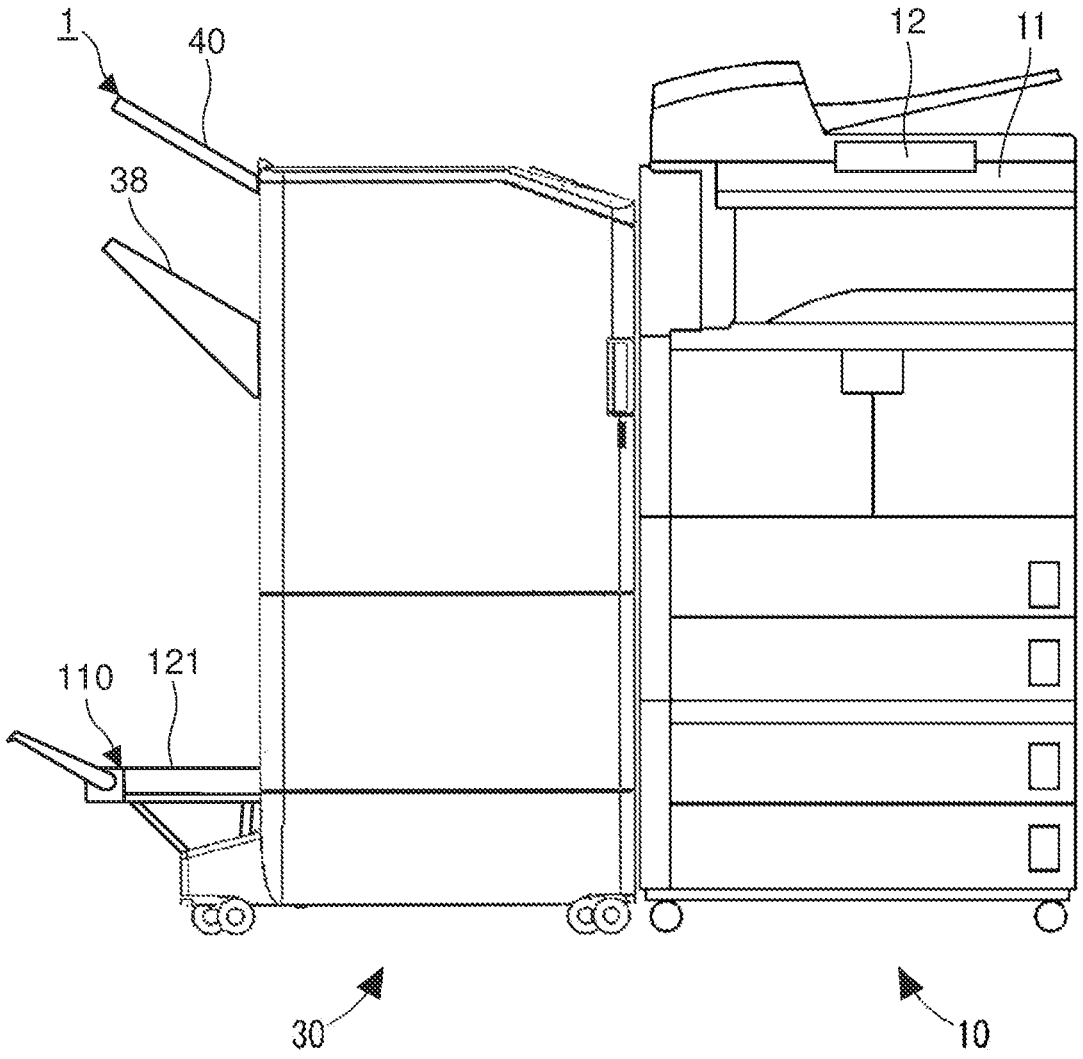
FIG. 1 is a schematic view showing an image forming apparatus and a sheet post-processing apparatus forming an image forming system.

An embodiment of this disclosure will be described below by referring to the drawings. For the convenience of description, a sheet including a single sheet and a bundle of a plurality of sheets will collectively be called a "sheet S" simply. A transport direction of the sheet S will be called a "sheet transport direction." A width direction of the sheet S (a direction perpendicular to the sheet transport direction) will be called a "sheet width direction." A loading direction in which the sheet S is loaded on a sheet loading unit 63 (a direction perpendicular to the sheet transport direction and the sheet width direction) will be called a "sheet loading direction."

FIG. 1 is a schematic view showing an image forming apparatus 10 and a sheet post-processing apparatus 30 forming an image forming system 1. As shown in FIG. 1, the image forming system 1 includes the image forming apparatus 10 and the sheet post-processing apparatus 30.

The image forming apparatus 10 is coupled to the sheet post-processing apparatus when used. The sheet post-processing apparatus 30 will be described later. The image forming apparatus 10 prints an image on the sheet S on the basis of image data input from outside through a network communication part not shown in the drawings or image data read by an image reader 11 arranged at the top of the image forming apparatus 10.

Figure 2:
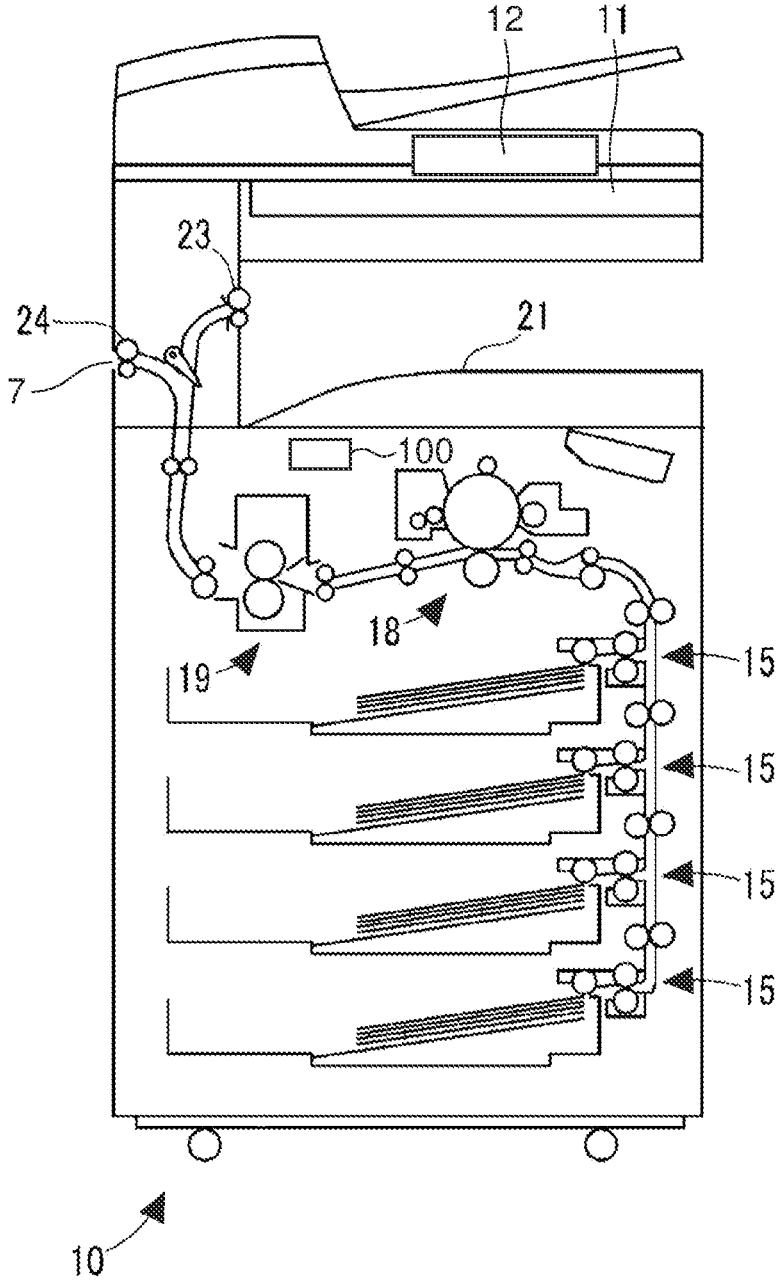
FIG. 2 is a schematic view showing an internal configuration of the image forming apparatus.

FIG. 2 is a schematic view showing an internal configuration of the image forming apparatus 10. As shown in FIG. 2, the image forming apparatus 10 includes a sheet feeder 15 that feeds the sheet S, an image forming part 18 that forms a toner image on the sheet S, a fixing part 19 for fixing the toner image on the sheet S, an ejection roller 23 and an ejection roller 24 in a pair for transporting and ejecting the sheet after fixation to a sheet ejection part 21 and to the sheet post-processing apparatus 30 respectively, and a body controller 100. The body controller 100 controls operation of the image forming apparatus 10. Furthermore, the body controller 100 is configured to be communicable with a post-processing controller 101 of the sheet post-processing apparatus 30 described later and controls the post-processing controller 101.

Figure 3:
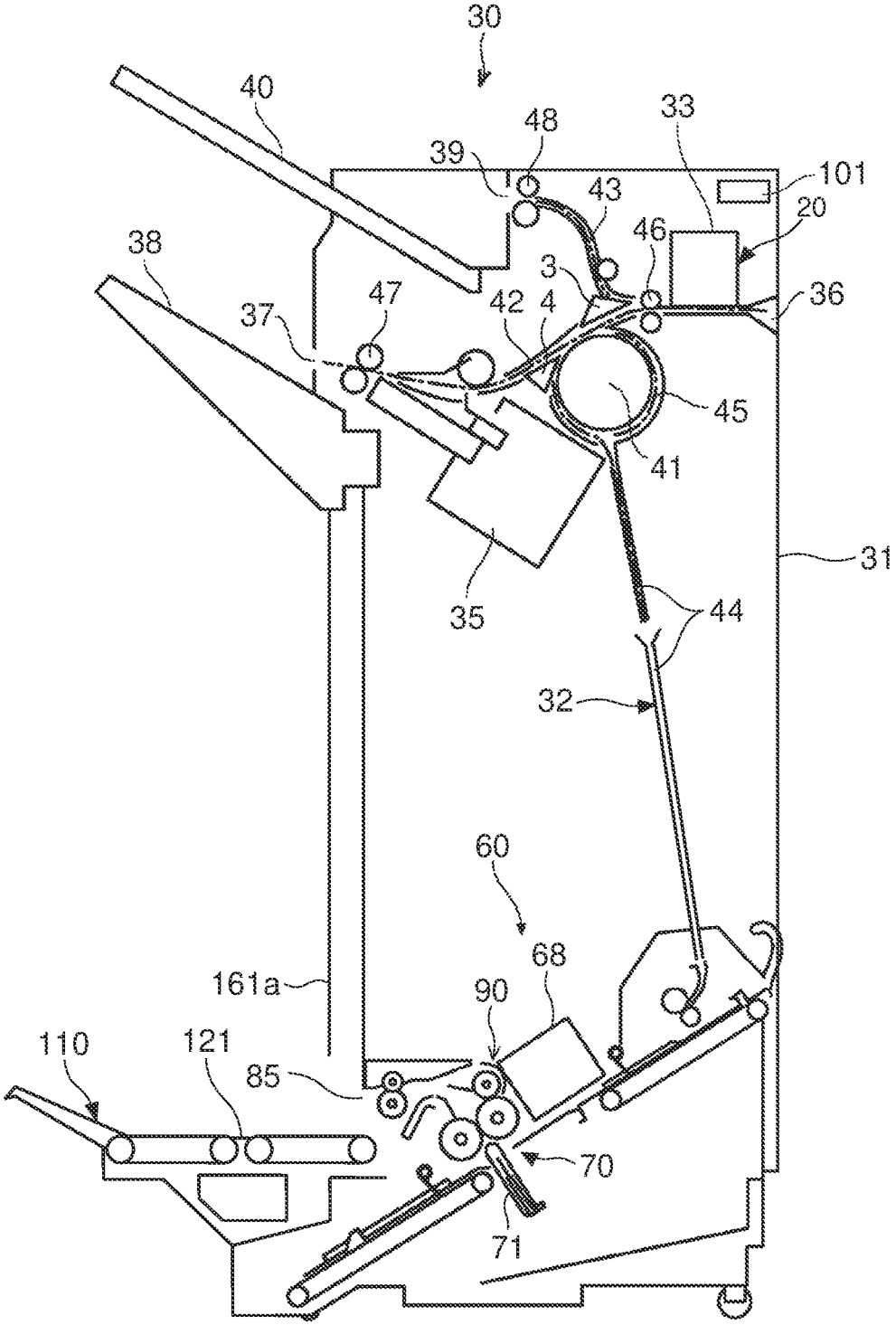
FIG. 3 is a schematic view showing an internal configuration of the sheet post-processing apparatus.

FIG. 3 is a schematic view showing an internal configuration of the sheet post-processing apparatus 30. The sheet post-processing apparatus 30 performs a post-process such as a punched hole forming process, a fastening process, or a folding process on the sheet having been transported from the image forming apparatus 10. As shown in FIG. 3, the sheet post-processing apparatus 30 includes a sheet inlet 36, a main ejection tray 38, a sub-ejection tray a lower ejection tray 121, a sheet transport path 32, a retreat drum 41, a registration roller pair 46, a post-processing mechanism 20, the post-processing controller 101, and a tray unit 110.

The sheet inlet 36 receives the sheet S having been ejected from an ejector 7 (see FIG. 2) of the image forming apparatus 10. Each of the main ejection tray 38, the sub-ejection tray 40, and the lower ejection tray 121 is a plate-like body having an upper surface on which the sheet S is loadable, and is a final destination of ejection of the sheet S having been brought into the sheet post-processing apparatus 30 through the sheet inlet 36.

The main ejection tray 38 is supported on a side surface 161*a* of a body of the sheet post-processing apparatus 30 (a side surface on the opposite side to the image forming apparatus 10) in such a manner as to be movable up and down. The main ejection tray 38 moves up and down in response to a load amount of the loaded sheet S. A main ejection opening 37 is formed at the side surface 161*a*. The main ejection opening 37 is located further above the main ejection tray 38 at the highest position.

The sub-ejection tray 40 is fixed to an upper part of the sheet post-processing apparatus 30 above the main ejection tray 38. A sub-ejection opening 39 is formed at a position above an upstream-side end portion of the sub-ejection tray 40 with respect to the sheet transport direction at an upper part of the body of the sheet post-processing apparatus 30.

The lower ejection tray 121 is supported at a lower part of the sheet post-processing apparatus 30 below the main ejection tray 38. A lower ejection opening 85 is formed at the side surface 161*a* and above the lower ejection tray 121.

The sheet transport path 32 is a path formed in the sheet post-processing apparatus for transport of a sheet. The sheet S transported into the sheet post-processing apparatus 30 through the sheet inlet 36 passes through the sheet transport path 32 and is transported to a predetermined position in the sheet post-processing apparatus 30. The sheet transport path 32 is composed of a first transport path 42, a second transport path 43, a third transport path 44, and a fourth transport path 45.

The first transport path 42 extends from the sheet inlet 36 to the main ejection opening 37. The first transport path 42 has a downstream-side end portion in the sheet transport direction where a main ejection roller pair 47 is provided. The main ejection roller pair 47 is roller bodies in a pair rotatable both in a forward direction and a reverse direction and configured in a manner allowing the roller bodies to contact each other under pressure or separate away from each other. The main ejection roller pair 47 can transport the sheet S in the sheet transport direction to the main ejection tray 38 or in a direction reverse to the sheet transport direction toward a first staple unit 35 described later.

For transport of the sheet S to the main ejection tray 38, the main ejection roller pair 47 is placed in a pressure-contacting state and rotated in the forward direction to feed the sheet S getting in between the rollers to the main ejection tray 38 through the main ejection opening 37. Conversely, for transport of the sheet S into the first staple unit 35, the main ejection roller pair 47 is placed in a separated state and the sheet S is put in between the rollers. Then, the main ejection roller pair 47 is placed in a pressure-contacting state and rotated in the reverse direction to feed the sheet S to the first staple unit 35.

The second transport path 43 branches upward from the first transport path 42 and extends toward the sub-ejection opening 39. The second transport path 43 has an upstream-side end portion connected to a halfway point along the first transport path 42, and a downstream-side end portion connected to the sub-ejection opening 39. A first branch member 3 is provided at a connection site between the first transport path 42 and the second transport path 43. The first branch member 3 sends the sheet S having been brought in through the sheet inlet 36 toward downstream of the first transport path 42 or to the second transport path 43.

A sub-ejection roller pair 48 is provided at the downstream-side end portion of the second transport path 43. The sub-ejection roller pair 48 feeds the sheet S having been transported to the second transport path 43 onto the sub-ejection tray 40 through the sub-ejection opening 39.

The third transport path 44 branches and extends downward from the first transport path 42. The third transport path 44 has an upstream-side end portion connected through the fourth transport path 45 described later to the first transport path 42 at a position downstream from a site from which the second transport path 43 branches. The third transport path 44 has a downstream-side end portion extending downward to be connected to a sheet folding device 60 described later.

The fourth transport path 45 is a ring-like transport path that branches from the first transport path 42 and rejoins the first transport path 42. More specifically, the fourth transport path 45 branches from the first transport path 42 at a position downstream from a branch site between the first transport path 42 and the third transport path 44 and rejoins the first transport path 42 at a further downstream position. The upstream-side end portion of the third transport path 44 is connected to a halfway point along the fourth transport path 45.

A second branch member 4 is provided at a connection site between the first transport path 42 and the fourth transport path 45. After the sheet S is sent downstream along the first transport path 42 by the first branch member 3, the second branch member 4 sends this sheet S further downstream along the first transport path 42 or to the third transport path 44 through the fourth transport path 45.

The retreat drum 41 is a rotatable roller body provided inside the ring-like fourth transport path 45. The retreat drum 41 has an outer peripheral surface facing an inner peripheral surface of the fourth transport path 45 to define the fourth transport path 45.

While the sheet S having been sent by the second branch member 4 in a direction toward the third transport path 44 contacts the outer peripheral surface of the retreat drum 41, the retreat drum 41 rotates to cause the sheet S to retreat once to the fourth transport path 45 and then feeds the sheet S again to the first transport path 42. To perform a fastening process continuously on a plurality of sheet bundles, for example, during implementation of the fastening process on a previous sheet bundle, the retreat drum 41 causes a first sheet S to form a subsequent sheet bundle to retreat to the fourth transport path 45. Then, the retreat drum 41 transports the first sheet S from the fourth transport path 45 again to the first transport path 42 in order for the first sheet S to be transported to the first staple unit 35 while being overlaid on a second sheet S.

The registration roller pair 46 is arranged along the first transport path 42 at a position upstream from the first branch member 3. The registration roller pair 46 feeds the sheet S downstream having been brought in through the sheet inlet 36.

The post-processing mechanism 20 includes a punched hole forming device 33, the first staple unit 35, the sheet folding device 60, and a second staple unit 68.

The punched hole forming device 33 is arranged between the sheet inlet 36 and the registration roller pair 46 with respect to the sheet transport direction. The punched hole forming device 33 faces the sheet S one above the other transported to the first transport path 42. The punched hole forming device 33 performs a hole punching process with predetermined timing on the sheet S transported along the first transport path 42.

The post-processing controller 101 is connected to the mechanisms of the sheet post-processing apparatus 30 (including the punched hole forming device 33, the first staple unit 35, and the sheet folding device 60), and is responsible for control over a predetermined post-process, transport of the sheet S, etc.

The first staple unit 35 is arranged below the first transport path 42 and at a position downstream from a connection site between the first transport path 42 and the third transport path 44 and upstream from the main ejection roller pair 47. The first staple unit 35 performs a stacking process and the fastening process on a plurality of the sheets S having been brought in by the motion of the main ejection roller pair 47 described above. The stacking process is a process of stacking a plurality of the sheets S to form a sheet bundle. The fastening process is a process of fastening the stacked sheet bundle with a staple.

Figure 4:
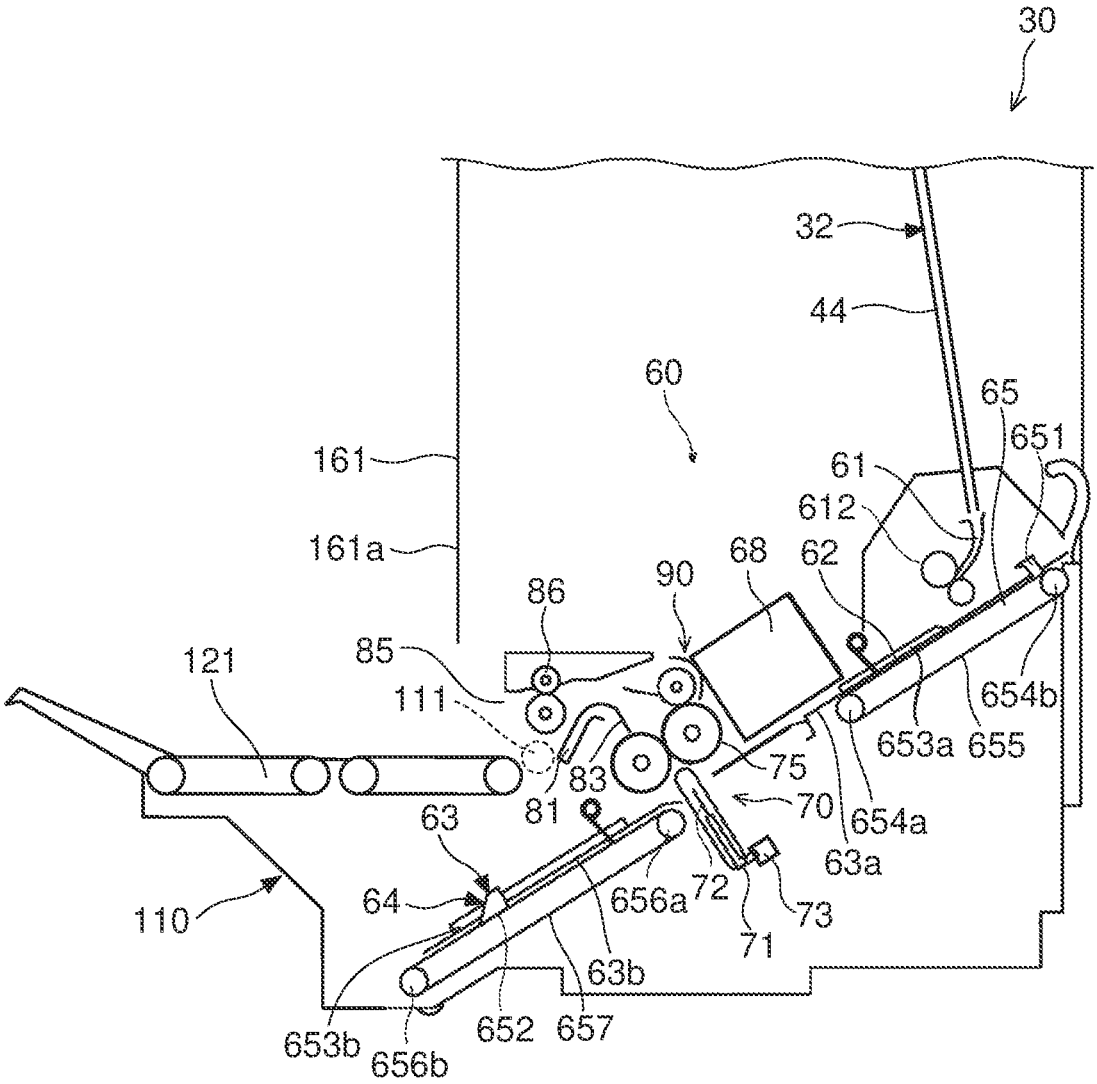
FIG. 4 is a sectional view showing the internal configuration of the sheet post-processing apparatus at a sheet folding device and the vicinity thereof.

FIG. 4 is a sectional view showing the internal configuration of the sheet post-processing apparatus 30 at the sheet folding device 60 and the vicinity thereof. As shown in FIG. 4, the sheet folding device 60 is provided at a lower part of the sheet post-processing apparatus 30 and downstream from the third transport path 44. In response to selection of the folding process by a user, for example, the sheet folding device 60 performs the folding process of folding the sheet S in two or three.

The sheet folding device 60 includes a sheet incoming path 61, the sheet loading unit 63, an alignment member 65, a sheet moving part 64, a first folding device 70 (folding processing unit), a standby path 81, a second folding device 90 (folding processing unit), a transport destination switching member 83, and the lower ejection tray (ejection tray) 121.

The sheet incoming path 61 is an incoming path for bringing the sheet S having been transported along the third transport path 44 into the sheet folding device 60. The sheet incoming path 61 extends downward from a downstream end of the third transport path 44. The sheet incoming path 61 has a downstream end where an incoming roller pair 612 is provided for feeding the sheet S into the sheet folding device 60.

The sheet loading unit 63 is a unit on which the incoming sheet S from the sheet incoming path 61 is loaded. The sheet loading unit 63 has a configuration including an upstream-side loading part 63*a* and a downstream-side loading part 63*b*.

The upstream-side loading part 63*a* and the downstream-side loading part 63*b* have plate-like members. The downstream-side loading part 63*b* is arranged downstream from the upstream-side loading part 63*a* with respect to the sheet transport direction and in line with the upstream-side loading part 63*a* with a space therefrom. The upstream-side loading part 63*a* has an upper surface where an upstream-side loading surface 24 (see FIG. 10) is formed. The downstream-side loading part 63*b* has an upper surface where a downstream-side loading surface 25 (see FIG. 11) is formed. The upstream-side loading surface 24 and the downstream-side loading surface 25 are arranged on the same plane in the sheet transport direction to form a sheet loading surface 62. The sheet loading surface 62 tilts downward from an upstream side toward a downstream side in the sheet transport direction.

The upstream-side loading surface 24 faces the second staple unit 68. The second staple unit 68 is capable of performing the fastening process on the sheet S loaded on the sheet loading surface 62.

The alignment member 65 aligns a marginal edge of the sheet S in the sheet width direction loaded on the sheet loading unit 63. The sheet moving part 64 moves the sheet S loaded on the sheet loading unit 63 to a predetermined position in the sheet transport direction. The alignment member 65 aligns each of the sheets S when these sheets S are loaded one by one on the sheet loading unit 63. The sheet moving part 64 moves the sheet S after the sheet S is aligned by the alignment member 65. When the number of the sheets S reaches a predetermined number, the sheets S are subjected to the fastening process by the second staple unit 68 if the fastening process is intended and then transported to the first folding device 70 while these sheets S are transported directly to the first folding device 70 if the fastening process is not intended.

The first folding device 70 performs a first folding process of folding the sheet S in two. The first folding device 70 includes a thrusting mechanism 71 and a first folding roller pair 75. The thrusting mechanism 71 thrusts the sheet S. The first folding roller pair 75 performs the folding process on the sheet S having been thrust by the thrusting mechanism 71.

The thrusting mechanism 71 includes a folding blade 72 and a thrust driving part 73. The folding blade 72 is a metallic plate-like member. The folding blade 72 is arranged between the upstream-side loading part 63*a* and the downstream-side loading part 63*b* with respect to the sheet transport direction. The folding blade 72 is supported in such a manner as to be movable back and forth in the sheet loading direction.

The thrust driving part 73 has a configuration including a motor capable of outputting driving force and a plurality of gears (not shown in the drawings), and is connected to the folding blade 72. The thrust driving part 73 outputs rotary driving force to the folding blade 72 to move the folding blade 72 back and forth.

Figure 5:
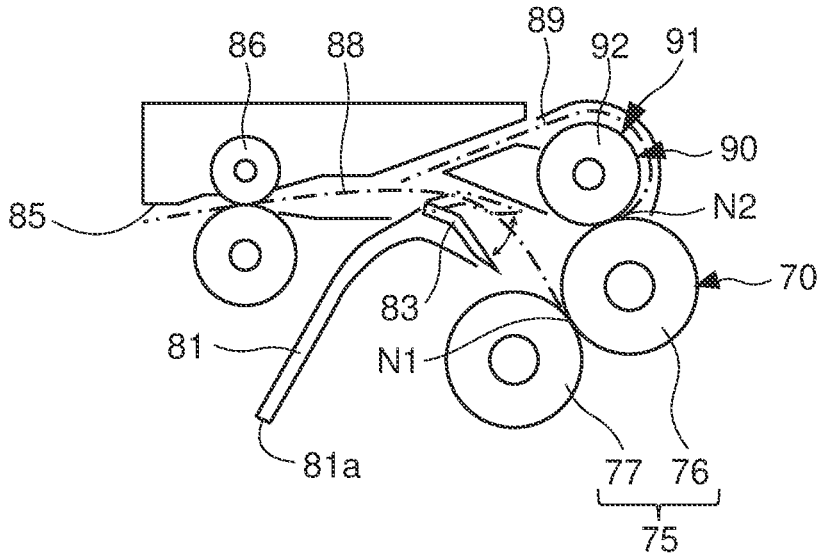
FIG. 5 is a sectional view showing a first folding device and the vicinity thereof in an enlarged manner.

FIG. 5 is a sectional view showing the first folding device 70 and the vicinity thereof in an enlarged manner. As shown in FIGS. 4 and 5, the first folding roller pair 75 is composed of a first roller 76 and a second roller 77. The first roller 76 and the second roller 77 contact each other under pressure to form a first nipping part N1 therebetween. The first roller 76 and the second roller 77 are driven to rotate by a driving part through a power transmission mechanism (both of which are not shown in the drawings).

After the sheet S is thrust by the folding blade 72, the sheet S enters the first nipping part N1. Then, the sheet S is caught between the first roller 76 and the second roller 77 at the first nipping part N1 and passes through the first nipping part N1, thereby forming a first fold in the sheet S.

A first ejection and transport path 88 leading to the lower ejection opening 85 is formed downstream from the first nipping part N1. The first ejection and transport path 88 has a downstream end where an ejection roller pair 86 is provided.

Figure 6:
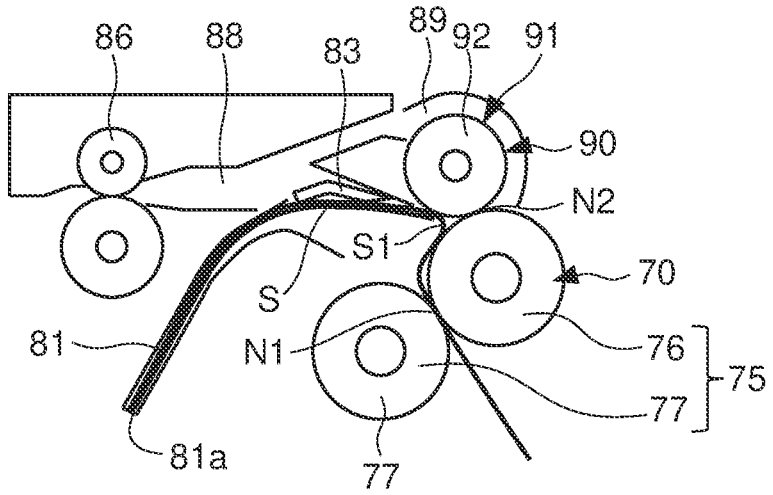
FIG. 6 is a sectional view showing the first folding device in an enlarged manner while a sheet is brought into the first folding device.

FIG. 6 is a sectional view showing the first folding device 70 in an enlarged manner while the sheet is brought into the first folding device 70. The standby path 81 branches from the first ejection and transport path 88. As shown in FIG. 6, the standby path 81 is a path where the sheet S having been subjected to the first folding process by the first folding device 70 enters and retreats while being warped. The standby path 81 is formed in response to the thickness of the sheets S of a maximum number that allows implementation of the folding process by the sheet folding device 60. If the number of the sheets S allowing implementation of the folding process is from 1 to 5, for example, the standby path 81 has a gap allowing entry of the sheets S corresponding to a thickness (the thicknesses of 10 sheets S) determined by folding five sheets S (resulting from implementation of the first folding process on the five sheets S).

The standby path 81 has a downstream end where a stopper 81*a* is provided. The first fold of the sheet S entering (retreating at) the standby path 81 abuts on the stopper 81*a*.

The second folding device 90 performs a second folding process on the sheet S while the sheet S abuts on the stopper 81*a*. The second folding device 90 includes a second folding roller pair 91. The second folding roller pair 91 is composed of the first roller 76 described above and a third roller 92.

The first roller 76 and the third roller 92 contact each other under pressure to form a second nipping part N2 therebetween. The third roller 92 is driven by rotate by the first roller 76. As shown in FIG. 6, if the first folding roller pair 75 continues the sheet transport while a tip (the first fold) of the sheet S having been subjected to the first folding process abuts on the stopper 81*a*, a warpage S1 is generated at the sheet S. The warpage S1 is caught between the first roller 76 and the third roller 92 at the second nipping part N2 and passes through the second nipping part N2, thereby forming a second fold in the sheet S.

The transport destination switching member 83 is provided at a branch site between the standby path 81 and the first ejection and transport path 88. The transport destination switching member 83 switches between the first ejection and transport path 88 and the standby path 81 and guides the sheet S having been subjected to the first folding process to the switched path. If the sheet S having been subjected to the first folding process is to be transported to the lower ejection opening 85 without implementation of the second folding process, the transport destination switching member 83 guides the sheet S from the first nipping part N1 directly to the first ejection and transport path 88 (see FIG. 7).

Referring back to FIG. 5, a second ejection and transport path 89 joining the first ejection and transport path 88 is provided downstream from the second nipping part N2. The second ejection and transport path 89 is a transport path along which the sheet S having been subjected to the second folding process is transported to the lower ejection opening 85 through the first ejection and transport path 88.

Figure 8:
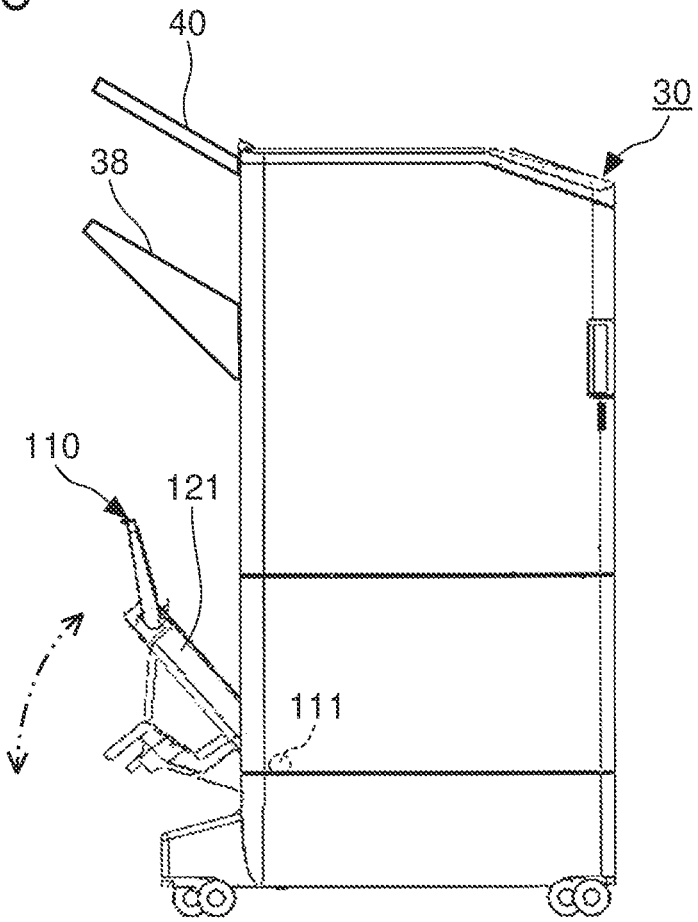
FIG. 8 is a side view of the sheet post-processing apparatus.
Figure 9:
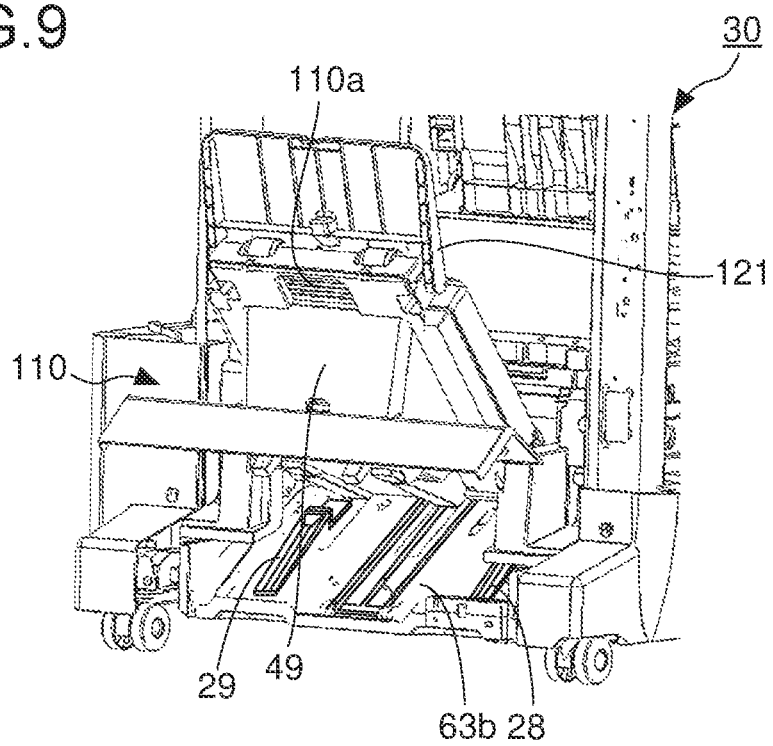
FIG. 9 is a perspective view showing the sheet post-processing apparatus while a tray unit is located at a second position.

FIG. 8 is a side view of the sheet post-processing apparatus 30. FIG. 9 is a perspective view showing the sheet post-processing apparatus 30 while the tray unit 110 is located at a second position. As shown in FIGS. 8 and 9, the tray unit 110 has a configuration including the above-described lower ejection tray 121, a tray body 49, and a pivot shaft 111. The lower ejection tray 121 is fixed to the top of the tray body 49.

The pivot shaft 111 is a shaft body parallel to the sheet width direction. The pivot shaft 111 is provided at an upstream-side end portion of the tray body 49 in a sheet ejection direction. The pivot shaft 111 is supported on a body part (such as a frame forming a housing) of the sheet post-processing apparatus 30. The tray body 49 is swingable in a peripheral direction of the pivot shaft 111 between a first position (a position shown in FIG. 4) at which the sheet S ejected from the lower ejection opening 85 can be loaded on the lower ejection tray 121 and the second position (a position shown in FIGS. 8 and 9) at which the sheet loading unit 63 inside the body of the sheet post-processing apparatus 30 is exposed from the side surface 161*a*.

Locating the tray unit 110 at the second position exposes a lower end portion and the vicinity thereof of the sheet loading unit 63. While the tray body 49 is at the second position, a jam of the sheet S occurring, for example, at the sheet loading unit 63 or the first folding device 70 (see FIG. 4) can be removed through a place under the tray unit 110.

The following describes the folding process (operation) on the sheet S by the sheet folding device 60 by referring to FIGS. 4 to 7.

A process of folding in two will be described first. The process of folding in two is performed when a user selects a mode of folding in two using an operation panel 12 of the image forming apparatus 10 (see FIG. 2). The transport destination switching member 83 pivots to a position indicated by a solid line in FIG. 5 to set a destination of transport of the sheet S having been subjected to the first folding process by the first folding device 70 to the first ejection and transport path 88.

The incoming sheet S from the sheet incoming path 61 is loaded on the upstream-side loading part 63*a* and the downstream-side loading part 63*b*. Then, the alignment member 65 aligns the edges of the sheet S in the sheet width direction. Next, the sheet moving part 64 locates the sheet S into position (moves the sheet S) in such a manner that a folding position at the sheet S (a central portion in the sheet transport direction) and a tip of the folding blade 72 overlap each other with respect to the sheet transport direction.

Next, the folding blade 72 is projected in a direction opposite to the sheet loading direction. This makes the tip of the folding blade 72 abut on a back surface of the sheet S, so that the sheet S is thrust upward (in a direction vertical to the sheet S) by the projection of the folding blade 72. The sheet S having been thrust by the folding blade 72 is warped and in this state, enters the first nipping part N1 at the first folding roller pair 75. The first fold is formed in the sheet S having passed through the first nipping part N1.

Figure 7:
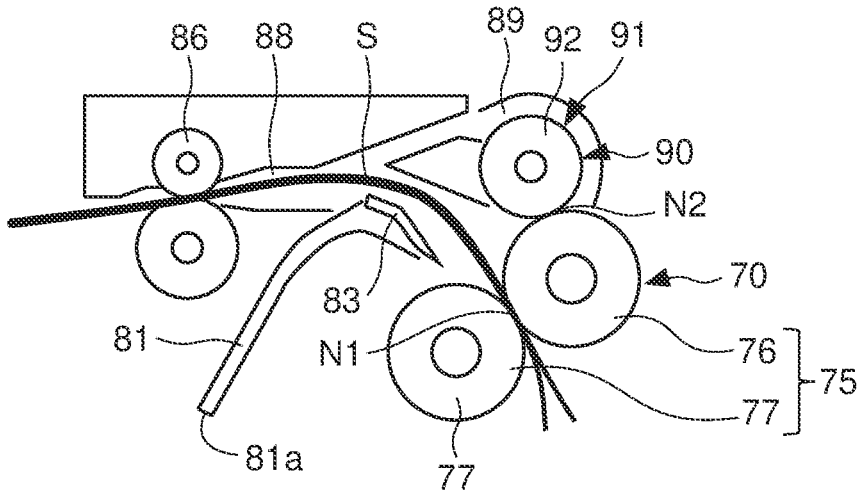
FIG. 7 is a sectional view showing the first folding device and the vicinity thereof in an enlarged manner while a sheet is ejected by an ejection roller pair.

As shown in FIG. 7, the sheet S with the first fold passes along the first ejection and transport path 88 and is then ejected to the lower ejection tray 121 through the lower ejection opening 85. The thrusting mechanism 71 returns the folding blade 72 to a former standby position. Then, the folding process is performed continuously in the same way.

A process of folding in three will be described next. The process of folding in three is performed when a user selects a mode of folding in three using the operation panel 12 of the image forming apparatus 10 (see FIG. 2). A procedure to be followed until implementation of the first folding process on the sheet S by the first folding device 70 will not be described as it is the same as the procedure in the above-described process of folding in two except that a folding position at the sheet S is set at a position separated by about ⅓ of a sheet length from a tip of the sheet S.

Referring back to FIG. 5, in the mode of folding in three, the transport destination switching member 83 pivots to a position indicated by a dash double-dot line in FIG. 5 to set a destination of transport of the sheet S having been subjected to the first folding process by the first folding device 70 to the standby path 81. Thus, the sheet S having been subjected to the first folding process is transported toward the standby path 81. When the sheet S enters the standby path 81, the first fold (tip) of the sheet S abuts on the stopper 81*a*.

The first folding roller pair 75 continues to rotate after the first fold of the sheet S abuts on the stopper 81*a*. By doing so, as shown in FIG. 6, the sheet S is warped in such a manner as to protrude toward the second nipping part N2 at the second folding roller pair 91 while abutting on a curved inner surface of the standby path 81, the transport destination switching member 83, etc.

The warpage S1 generated at the sheet S (at a position separated by about ⅓ of the sheet length from a rear end of the sheet S) enters the second nipping part N2 at the second folding roller pair 91. The second fold is formed in the sheet S having passed through the second nipping part N2. The sheet S with the second fold is transported along the second ejection and transport path 89 while being wound on a peripheral surface of the third roller 92 to be ejected by the ejection roller pair 86 to the lower ejection tray 121 through the lower ejection opening 85.

The configurations of the alignment member 65 and the sheet moving part 64 will be described next in detail. Referring back to FIG. 4, the alignment member 65 includes an upstream-side widthwise alignment member 653*a* (an upstream-side alignment part) and a downstream-side widthwise alignment member 653*b* (a downstream-side alignment part). The sheet moving part 64 includes an upper moving member 651 (a first claw part) and a lower moving member 652 (a second claw part).

The upper moving member 651 is supported on the upstream-side loading part 63*a* in such a manner as to be movable back and forth in the sheet transport direction. An upstream-side driving pulley 654*a* and an upstream-side driven pulley 654*b* are provided below the upstream-side loading part 63*a*. An upstream-side belt 655 is stretched around the upstream-side driving pulley 654*a* and the upstream-side driven pulley 654*b*. The upper moving member 651 is attached to the upstream-side belt 655. The upstream-side driving pulley 654*a* is connected to a driving part such as a motor (not shown in the drawings), and is caused to rotate by the rotary driving force of the driving part. The rotation of the upstream-side driving pulley 654*a* drives the upstream-side belt 655 to rotate, thereby moving the upper moving member 651 back and forth.

The lower moving member 652 is supported on the downstream-side loading part 63*b* in such a manner as to be movable back and forth in the sheet transport direction. A downstream-side driving pulley 656*a* and a downstream-side driven pulley 656*b* are provided below the downstream-side loading part 63*b*. A downstream-side belt 657 is stretched around the downstream-side driving pulley 656*a* and the downstream-side driven pulley 656*b*. The lower moving member 652 is attached to the downstream-side belt 657. The downstream-side driving pulley 656*a* is connected to a driving part such as a motor (not shown in the drawings), and is caused to rotate by the rotary driving force of the driving part. The rotation of the downstream-side driving pulley 656*a* drives the downstream-side belt 657 to rotate, thereby moving the lower moving member 652 back and forth.

The lower moving member 652 abuts on a tip (a downstream-side end portion in the sheet transport direction) of the sheet S loaded on the sheet loading surface 62 to receive the tip of the sheet S. The upper moving member 651 receives a rear end (an upstream-side end portion in the sheet transport direction) of the sheet S received by the lower moving member 652. In this way, the upper moving member 651 and the lower moving member 652 abut on the opposite marginal edges of the sheet S in the sheet transport direction loaded on the sheet loading unit 63 to align the tip and the rear end of the sheet S at predetermined positions.

The upstream-side widthwise alignment member 653*a* and the downstream-side widthwise alignment member 653*b* are each configured to move in the sheet width direction in conformity with the size (a length in the sheet width direction) of the sheet S. The upstream-side widthwise alignment member 653*a* and the downstream-side widthwise alignment member 653*b* abut on the opposite marginal edges of the sheet S with respect to the sheet width direction, thereby making the widthwise alignment and correction of oblique movement of the sheet S.

Figure 10:
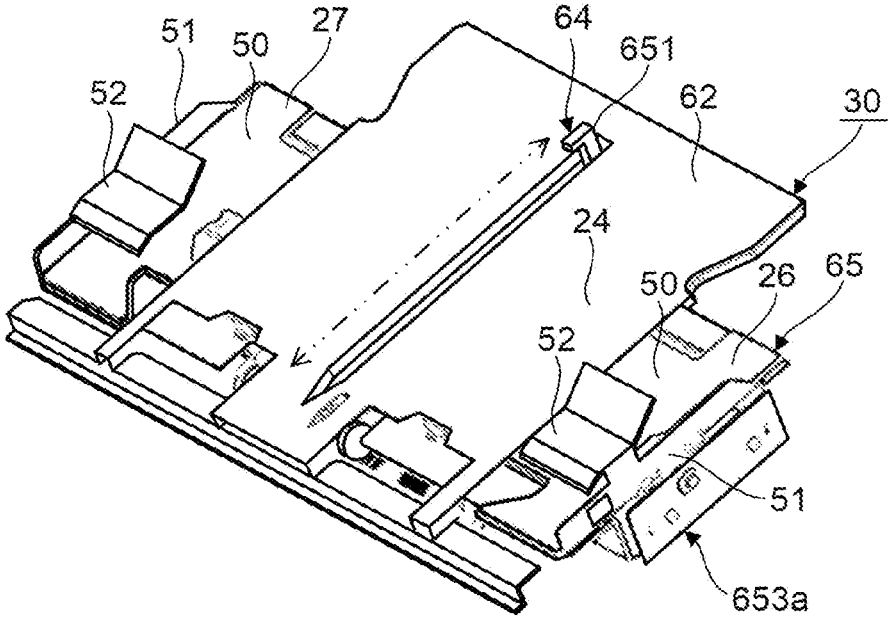
FIG. 10 is a perspective view showing an upstream-side loading part.

FIG. 10 is a perspective view showing the upstream-side loading part 63*a*. As shown in FIG. 10, the upstream-side widthwise alignment member 653*a* is composed of first regulation members 26 and 27 in a pair. The first regulation members 26 and 27 are arranged side by side in the sheet width direction. The first regulation members 26 and 27 are located at positions overlapping the upstream-side loading part 63*a* with respect to the sheet transport direction. The first regulation members 26 and 27 are supported on the upstream-side loading part 63*a* by a rack-and-pinion mechanism (not shown in the drawings) in such a manner as to be movable back and forth in the sheet width direction.

The first regulation members 26 and 27 are symmetrical to each other in the sheet width direction and basically have the same configuration. For this reason, the following description is only about the first regulation member 26 while description of the second regulation member 27 given the same signs will be omitted.

The first regulation member 26 includes an upstream-side bottom surface 50, an upstream-side side wall section 51, and an upstream-side flat section 52. The upstream-side bottom surface 50 is parallel to the upstream-side loading surface 24. The upstream-side bottom surface 50 is located below the upstream-side loading surface 24. Specifically, while the sheet S is loaded on the sheet loading surface 62, the upstream-side bottom surface 50 is located at a position farther from the sheet S than the upstream-side loading surface 24.

The upstream-side side wall section 51 is a plate-like section vertical to the upstream-side bottom surface 50. The upstream-side side wall section 51 is continuous with an external marginal edge of the upstream-side bottom surface 50 with respect to the sheet width direction (on an outer side of the sheet width direction).

The upstream-side flat section 52 is a plate-like section parallel to the upstream-side bottom surface 50. The upstream-side flat section 52 extends from a marginal edge of the upstream-side side wall section 51 in a direction opposite to the sheet loading direction toward an inner side of the sheet width direction (toward the center of the upstream-side loading surface 24 with respect to the sheet width direction). The upstream-side flat section 52 faces the upstream-side bottom surface 50 with respect to the sheet loading direction.

Figure 11:
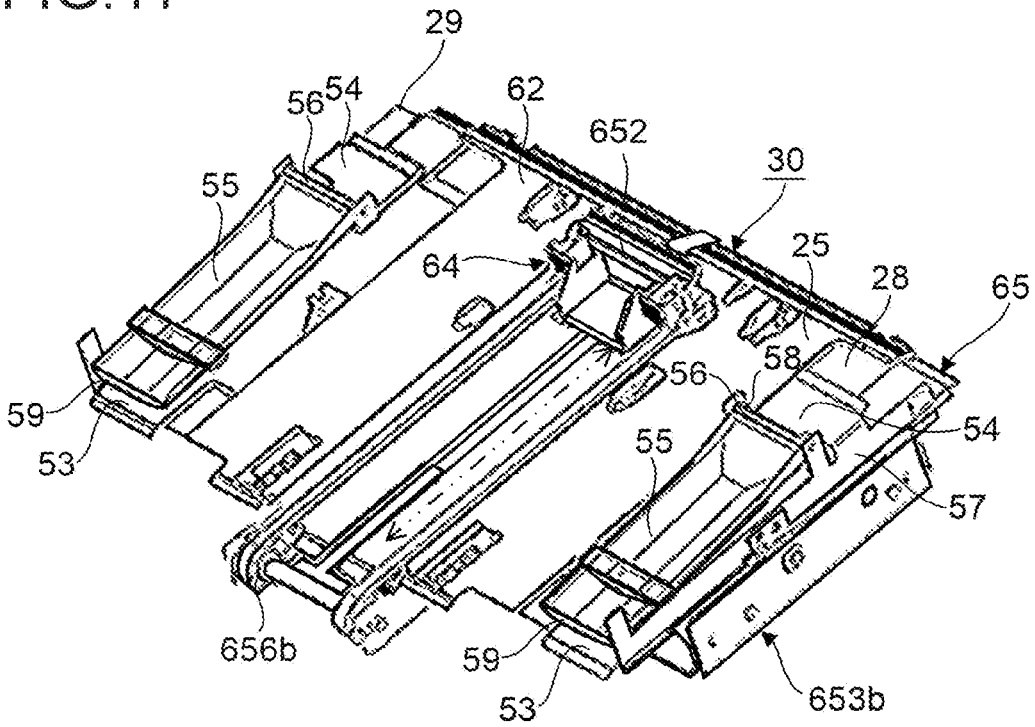
FIG. 11 is a perspective view showing a downstream-side loading part.
Figure 12:
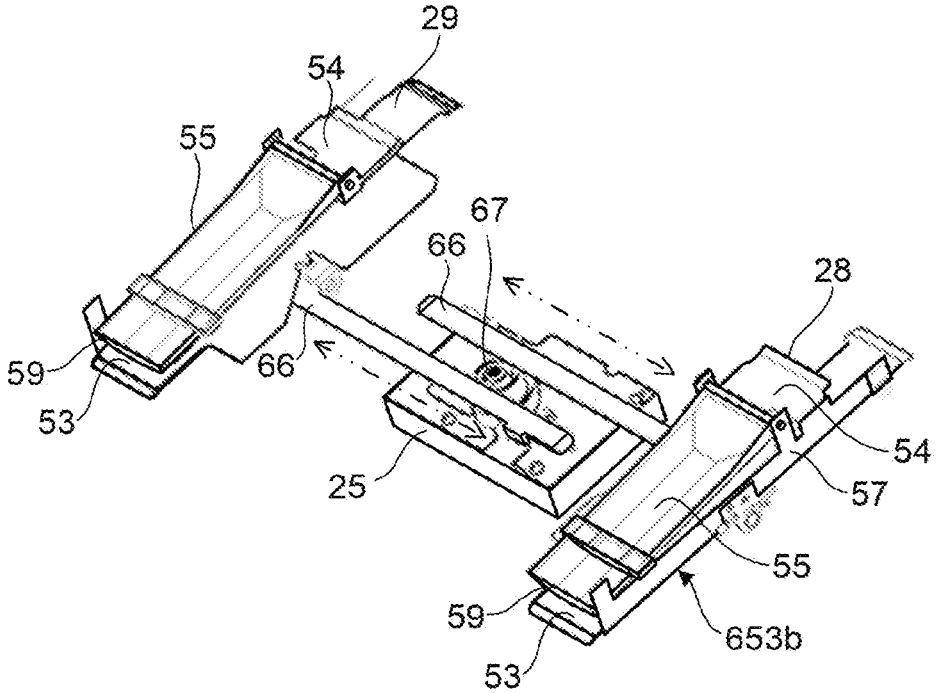
FIG. 12 is a perspective view showing a downstream-side widthwise alignment member.

FIG. 11 is a perspective view showing the downstream-side loading part 63*b*. FIG. 12 is a perspective view showing the downstream-side widthwise alignment member 653*b*. As shown in FIGS. 11 and 12, the downstream-side widthwise alignment member 653*b* is composed of a second regulation member 28 and a second regulation member 29. The second regulation members 28 and 29 are adjacent to each other in the sheet width direction. The second regulation members 28 and 29 are located at positions overlapping the downstream-side loading part 63*b* with respect to the sheet transport direction. While the tray unit 110 is located at the second position, the regulation members 28 and 29 are exposed to the outside from the lower ejection opening 85 (see FIG. 9).

The second regulation members 28 and 29 are symmetrical to each other in the sheet width direction and basically have the same configuration. For this reason, the following description is only about the second regulation member 28 while description of the second regulation member 29 given the same signs will be omitted.

The second regulation member 28 includes a downstream-side bottom surface 53, a rack gear 66, a downstream-side side wall section 57, a downstream-side flat section 54 (fixed guide plate), and a guide plate 55 (movable guide plate). The downstream-side bottom surface 53 is parallel to the downstream-side loading surface 25. The downstream-side bottom surface 53 is located below the downstream-side loading surface 25. Specifically, while the sheet S is loaded on the sheet loading surface 62, the downstream-side bottom surface 53 is located at a position farther from the sheet S than the downstream-side loading surface 25.

The rack gear 66 extends in the sheet width direction from the downstream-side bottom surface 53 across the center of the downstream-side loading part 63*b*. The rack gear 66 of the second regulation member 28 and the rack gear 66 of the second regulation member 29 face each other in the sheet transport direction. A pinion gear 67 is arranged between the rack gear 66 of the second regulation member 28 and the rack gear 66 of the second regulation member 29. The pinion gear 67 is rotatably supported on the downstream-side loading part 63*b*.

The rack gears 66 of the second regulation members 28 and 29 and the pinion gear 67 are engaged with each other to form a rack-and-pinion mechanism. The pinion gear 67 is connected to a driving part such as a motor (not shown in the drawings), and is caused to rotate by rotary driving force output from the driving part. In response to the rotation of the pinion gear 67, the second regulation members 28 and 29 move back and forth across the rack gear 66 in such a manner as to move closer to or away from each other in the sheet width direction.

The downstream-side side wall section 57 is a plate-like section vertical to the downstream-side bottom surface 53. The downstream-side side wall section 57 is continuous with an external marginal edge of the downstream-side bottom surface 53 with respect to the sheet width direction (on the opposite side to the center of the downstream-side loading surface with respect to the sheet width direction).

When the second regulation members 28 and 29 move in such a manner as to move closer to each other in the sheet width direction to bring the downstream-side side wall sections 57 of the second regulation members 28 and 29 into contact with opposite marginal edges of the sheet S in the sheet width direction loaded on the downstream-side loading surface 25, the opposite marginal edges of the sheet S with respect to the sheet width direction are justified (aligned) at predetermined positions.

The downstream-side flat section 54 is a plate-like section parallel to the downstream-side bottom surface 53. The downstream-side flat section 54 extends from a marginal edge of the downstream-side side wall section 57 in a direction opposite to the sheet loading direction toward an inner side of the sheet width direction (toward the center of the downstream-side loading surface 25 with respect to the sheet width direction). The downstream-side flat section 54 faces the downstream-side bottom surface 53 with respect to the sheet loading direction.

The guide plate 55 is a plate-like member elongated in the sheet transport direction. The guide plate 55 is supported on the downstream-side side wall section 57 in such a manner that the guide plate 55 can be caused to swing by a swing shaft 56 extending parallel to the sheet width direction in a peripheral direction of the swing shaft 56. The guide plate 55 is located downstream from the downstream-side flat section 54 with respect to the sheet transport direction. The guide plate 55 is located at a position overlapping the downstream-side flat section 54 with respect to the sheet width direction.

The guide plate 55 includes a support part 58 and an up-down part 59. The support part 58 is an upstream-side end portion of the guide plate 55 with respect to the sheet transport direction. The up-down part 59 is a downstream-side end portion of the guide plate 55 with respect to the sheet transport direction. The support part 58 faces the downstream-side side wall section 57 with respect to the sheet width direction.

Figure 13:
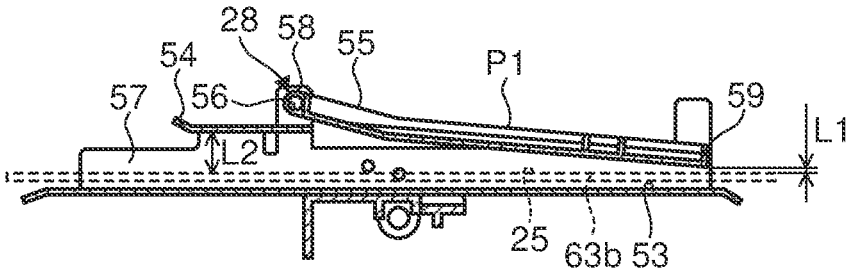
FIG. 13 is a sectional view showing a section of a second regulation member perpendicular to a sheet width direction while the second regulation member is at a regulation position.
Figure 14:
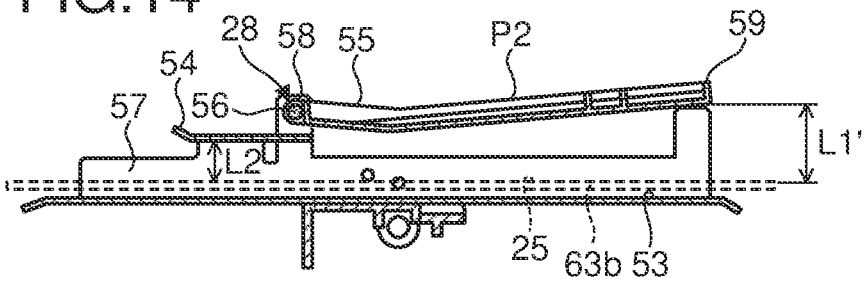
FIG. 14 is a sectional view showing a section of the second regulation member perpendicular to the sheet width direction while the second regulation member is at a retreat position.
Figure 15:
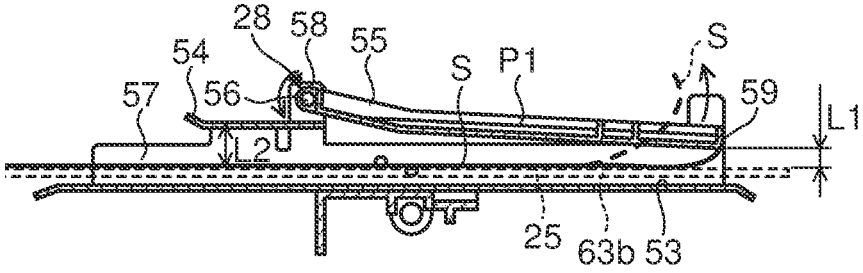
FIG. 15 is a sectional view showing a section of the second regulation member perpendicular to the sheet width direction while a sheet loaded on a downstream-side loading surface contacts an up-down part.

FIG. 13 is a sectional view showing a section of the second regulation member 28 perpendicular to the sheet width direction while the second regulation member 28 is at a regulation position P1. FIG. 14 is a sectional view showing a section of the second regulation member 28 perpendicular to the sheet width direction while the second regulation member 28 is at a retreat position P2. FIG. 15 is a sectional view showing a section of the second regulation member 28 perpendicular to the sheet width direction while the sheet S loaded on the downstream-side loading surface 25 contacts the up-down part 59.

As shown in FIGS. 11 to 14, the swing shaft 56 penetrates the downstream-side side wall section 57 and the support part 58 in the sheet width direction and is fixed to the downstream-side side wall section 57. The swing shaft 56 penetrates the support part 58 while leaving a slight gap from the support part 58. The support part 58 is swingable in the peripheral direction about the swing shaft 56. When the guide plate 55 swings in the peripheral direction of the swing shaft 56, the up-down part 59 moves closer to (moves down) or moves away from (moves up) the downstream-side loading surface 25 and the downstream-side bottom surface 53.

The guide plate 55 swings between the regulation position P1 and the retreat position P2. The regulation position P1 is a position where the up-down part 59 comes closer to the downstream-side loading surface 25 than the downstream-side flat section 54 with respect to the sheet loading direction (a position shown in FIG. 13). In this state, a clearance L1 between the up-down part 59 and the downstream-side loading surface 25 is less than a clearance L2 between the downstream-side flat section 54 and the downstream-side loading surface 25. While the guide plate 55 does not contact the sheet S, the guide plate 55 is located at the regulation position P1 under its own weight.

The retreat position P2 is a position where the up-down part 59 is separated further from the downstream-side loading surface 25 than the downstream-side flat section 54 with respect to the sheet loading direction (a position shown in FIG. 14). In this state, a clearance L1' between the up-down part 59 and the downstream-side loading surface 25 is greater than the clearance L2 between the downstream-side flat section 54 and the downstream-side loading surface 25. When a tip (a downstream-side end portion in the sheet transport direction) of the sheet S loaded on the downstream-side loading surface 25 comes into contact with the up-down part 59 of the vicinity thereof of the guide plate 55, the guide plate 55 is biased toward the retreat position P2.

As shown in FIG. 15, the sheet S transported on the downstream-side loading part 63*b* is passed through a place from the downstream-side flat section 54 and the guide plate 55 to the sheet loading surface 62 with respect to the sheet loading direction. If the tip (the downstream-side end portion in the sheet transport direction) of the sheet S curls up, the up-down part 59 contacts the sheet S. At this time, the curling portion of the sheet S presses the up-down part 59 upward. Conversely, the guide plate 55 holds down the curling portion under its own weight against the pressing force of the sheet S. As a result, the curl of the sheet S is corrected. At this time, the guide plate 55 is biased by restoring force generated at the curling portion of the sheet S from the regulation position P1 toward the retreat position P2.

As indicated by a dashed line in FIG. 15, if the curl of the sheet S is not corrected, the tip of the sheet S curls back toward a rear end. If the lower moving member 652 is to contact the sheet S in this state, the lower moving member 652 touches the curling portion of the sheet S. This makes it difficult to precisely locate the sheet S into position in the sheet transport direction.

Meanwhile, according to this disclosure, configuring the sheet folding device 60 in the manner of the foregoing embodiment makes the clearance L1 between the sheet S and the up-down part 59 less than the clearance L2 between the sheet S and the downstream-side flat section 54 while the guide plate 55 is at the regulation position P1, as described above. This locates the sheet S having been transported to the sheet loading unit 63 at a position closer to the up-down part 59 than to the downstream-side flat section 54. Thus, even if a tip of the sheet S curls up, the contact with the up-down part 59 allows correction of the curl. Furthermore, the curl can be corrected more intensely than in a case of correcting the curl by the contact with the downstream-side flat section 54. This allows the lower moving member 652 to locate the sheet S into position more correctly in the sheet transport direction by coming into contact with the tip of the sheet S. As a result, it is possible to provide the sheet folding device 60 capable of suppressing deviation of the position of the sheet S in the sheet transport direction loaded on the sheet loading unit 63.

As described above, while the guide plate 55 does not contact the sheet S, the guide plate 55 is located at the regulation position P1 under its own weight. While the guide plate 55 contacts the sheet S, the guide plate 55 corrects a curl of the sheet S under its own weight. In this way, it is possible to correct the curl of the sheet S through swinging motion of the guide plate 55 without using a complicated configuration.

As described above, while the tray unit 110 is located at the second position, the regulation members 28 and 29 are exposed to the outside from the lower ejection opening 85. Thus, if a jam of the sheet S occurs on the sheet loading surface 62, for example, the sheet S on the downstream-side loading surface 25 can be taken out easily.

As described above, while the guide plate 55 is at the retreat position P2, the clearance L1' between the up-down part 59 and the downstream-side loading surface 25 is greater than the clearance L2 between the downstream-side flat section 54 and the downstream-side loading surface 25. Thus, in taking out the sheet S on the downstream-side loading surface 25, the sheet S can be taken out more easily.

Furthermore, this disclosure is not limited to the above-described embodiment but can be subjected to various changes within a range not deviating from the purport of this disclosure. For example, in the example given in the above-described embodiment, the sheet folding device 60 includes the first folding device 70 and the second folding device 90. However, this disclosure is not limited to this. The sheet folding device 60 may not include the second folding device 90.

In the above-described embodiment, a multifunction machine is given as an example of the image forming apparatus 10. However, the image forming apparatus 10 may be an image forming apparatus (such as a laser printer, an inkjet printer, or a facsimile machine) other than a digital multifunction machine.

This disclosure is applicable to an image forming system including a sheet post-processing apparatus incorporated thereto that performs a post-process such as a fastening process on a sheet on which an image is formed by an image forming apparatus. By the application of this disclosure, it is possible to provide a sheet folding device capable of suppressing deviation of the position of a sheet in a sheet transport direction loaded on a sheet loading unit, a sheet post-processing apparatus including the sheet folding device, and an image forming system.

What is claimed is:

1. A sheet folding device comprising:

a sheet loading unit on which a sheet having passed through a sheet transport path is loaded;

a folding processing unit that includes a folding roller pair and performs a predetermined folding process on the sheet loaded on the sheet loading unit by nipping the sheet using the folding roller pair; and an ejection roller arranged downstream from the folding processing unit with respect to a sheet transport direction, the ejection roller ejecting the sheet having been subjected to the folding process downstream of the sheet transport direction, wherein the sheet loading unit includes:

a sheet loading tray on which the sheet is loaded;

a sheet alignment part supported on the sheet loading tray in such a manner as to be movable back and forth with respect to a sheet width direction perpendicular to the sheet transport direction, the sheet alignment part abutting on the sheet loaded on the sheet loading unit to locate the sheet into position in the sheet width direction; and a sheet moving part supported on the sheet loading tray in such a manner as to be movable back and forth with respect to the sheet transport direction, the sheet moving part moving the sheet loaded on the sheet loading unit to a predetermined position in the sheet transport direction, the sheet loading tray includes:

an upstream-side loading part arranged upstream of the sheet transport direction across a space formed at a position facing a nipping part at the folding roller pair, the upstream-side loading part including an upstream-side loading surface; and a downstream-side loading part arranged downstream of the sheet transport direction across the space, the downstream-side loading part including a downstream-side loading surface, the sheet alignment part includes:

an upstream-side alignment part that abuts on a portion of the sheet loaded on the upstream-side loading part to locate the sheet into position in the sheet width direction; and a downstream-side alignment part that abuts on a portion of the sheet loaded on the downstream-side loading part to locate the sheet into position in the sheet width direction, and the downstream-side alignment part includes:

a side plate arranged upright to the downstream-side loading surface and abutting on a side surface of the sheet;

a fixed guide plate provided upstream of the sheet transport direction from the side plate in such a manner as to face the downstream-side loading surface at a predetermined height from the downstream-side loading surface, the fixed guide plate regulating an upper surface of the sheet; and a movable guide plate provided downstream from the fixed guide plate with respect to the sheet transport direction, the movable guide plate being supported on the side plate in such a manner that a part upstream from a central part of the movable guide plate in the sheet transport direction is swingable between a retreat position and a regulation position about a fulcrum located above the fixed guide plate, the retreat position being a position where a downstream-side end portion of the movable guide plate in the sheet transport direction is located above the fixed guide plate, the regulation position being a position where the downstream-side end portion regulates an upper surface of the sheet at a position below the fixed guide plate.

2. The sheet folding device according to claim 1, wherein the sheet moving part includes:

a first claw part arranged in such a manner as to be movable back and forth in the sheet transport direction on the upstream-side loading surface, the first claw part abutting on an upstream-side end portion of the sheet loaded on the sheet loading unit; and a second claw part arranged in such a manner as to be movable back and forth in the sheet transport direction on the downstream-side loading surface, the second claw part abutting on a downstream-side end portion of the sheet loaded on the sheet loading unit, wherein the sheet is located into position in the sheet transport direction by interposing the sheet using the first claw part and the second claw part.

3. The sheet folding device according to claim 1, wherein the movable guide plate is located at the regulation position under its own weight in a state of not contacting the sheet, and is pressed up by coming into contact with the sheet to swing upward from the regulation position.

4. The sheet folding device according to claim 1, wherein the folding processing unit includes:

a folding blade facing the nipping part at the folding roller pair and arranged between the upstream-side loading part and the downstream-side loading part with respect to the sheet transport direction, the folding blade pressing a portion of the sheet including the center of the sheet in the sheet transport direction loaded on the sheet loading unit to insert the sheet into the nipping part at the folding roller pair across the space.

5. A sheet post-processing apparatus comprising:

the sheet folding device according to claim 1;

a first transport path along which the sheet having been brought in through an inlet is transported;

a second transport path along which the sheet having been transported from the first transport path is transported to the sheet transport path; and a first processing unit that performs a predetermined post-process on the sheet having been transported along the first transport path, and transports the sheet having been subjected to the post-process to the second transport path or to an ejection tray on which the sheet is loadable.

6. An image forming system comprising:

the sheet post-processing apparatus according to claim 5; and an image forming apparatus coupled to the sheet post-processing apparatus, the image forming apparatus forming an image on the sheet and transporting the sheet on which the image is formed to the sheet post-processing apparatus.

7. A sheet loading device comprising:

a transport part that transports a sheet;

a sheet loading unit including a loading surface on which the sheet transported from the transport part is loaded;

a sheet moving part supported on the loading surface in such a manner as to be movable back and forth with respect to a sheet transport direction, the sheet moving part moving the sheet loaded on the sheet loading unit to a predetermined position in the sheet transport direction; and a sheet alignment part supported on the loading surface in such a manner as to be movable back and forth in a sheet width direction perpendicular to the sheet transport direction, the sheet alignment part abutting on the sheet loaded on the sheet loading unit to locate the sheet at a predetermined position in the sheet width direction, wherein the sheet alignment part includes:

cursors in a pair facing each other in the sheet width direction and supported in such a manner as to be movable in an approaching and separating direction of moving closer to and away from each other, the cursors in a pair each include:

a side plate arranged upright from the loading surface and abutting on a side surface of the sheet;

a fixed guide plate provided upstream from a central portion of the side plate with respect to the sheet transport direction and jutting over the loading surface from the side plate in the approaching and separating direction; and a movable guide plate arranged downstream from the fixed guide plate, supported on the side plate in such a manner as to be swingable about a fulcrum located above the fixed guide plate, and extending downstream of the sheet transport direction from the fulcrum to regulate an upper surface of the sheet, the fixed guide plate is fixed to the side, guides the sheet downstream, and regulates a loading height of the sheet, the movable guide plate is swingable between a regulation position where a downstream-side end portion of the movable guide plate in the sheet transport direction is at a lower height than the fixed guide plate and a retreat position where the downstream-side end portion is at a greater height than the fixed guide plate, and regulates a loading height of the sheet to a position lower than the fixed guide plate while the movable guide plate is at the regulation position, and the sheet moving part is guided by the movable guide plate and locates a downstream-side end portion of the sheet regulated in the loading height to a predetermined position in the sheet transport direction.

* * * * *